US009454105B1

(12) United States Patent
Onishi

(10) Patent No.: US 9,454,105 B1
(45) Date of Patent: Sep. 27, 2016

(54) IMAGE FORMING APPARATUS CAPABLE OF REMOVING AN AGGLOMERATE OF DEVELOPING AGENT

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kei Onishi, Mishima (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/802,156

(22) Filed: Jul. 17, 2015

(51) Int. Cl.
*G03G 15/09* (2006.01)
*G03G 15/08* (2006.01)

(52) U.S. Cl.
CPC ..... *G03G 15/0935* (2013.01); *G03G 15/081* (2013.01)

(58) Field of Classification Search
CPC ..... G03G 15/0812; G03G 15/09; G03G 15/0921; G03G 15/0928; G03G 15/081; G03G 15/0935
USPC ..... 399/274, 276, 284
See application file for complete search history.

(56) References Cited

U.S. PATENT DOCUMENTS

| | | | | |
|---|---|---|---|---|
| 7,567,764 | B2 * | 7/2009 | Yamanaka | G03G 15/0812 399/284 |
| 7,856,199 | B2 * | 12/2010 | Tomizawa | G03G 15/09 399/274 |
| 2007/0110482 | A1 * | 5/2007 | Kazaki | G03G 15/0812 399/284 |
| 2013/0216250 | A1 | 8/2013 | Seki et al. | |

* cited by examiner

*Primary Examiner* — William J Royer
(74) *Attorney, Agent, or Firm* — Amin, Turocy & Watson LLP

(57) ABSTRACT

An image forming apparatus includes a developing roller including a magnet in which a plurality of magnetic poles are arranged and a rotatable sleeve which conveys a developing agent including toner and carrier to develop a latent image formed on a photoconductor, a motor configured to rotate the sleeve and a rotational direction of a motor control section configured to rotate the motor forward or reversely when an image forming job is completed, to rotate the sleeve in a direction reverse to a rotational direction of the sleeve in the image forming job for a reverse rotation time and then rotate the sleeve in a direction the same as the rotational direction of the sleeve in the image forming job for a forward rotation time shorter than the reverse rotation time.

8 Claims, 7 Drawing Sheets

IMAGE FORMING APPARATUS CAPABLE OF REMOVING AN AGGLOMERATE OF DEVELOPING AGENT

FIELD

Embodiments described herein relate generally to an image forming apparatus which forms a developed image using a two-component developing agent including toner and carrier.

BACKGROUND

In an electrophotographic image forming apparatus (Multi-functional Peripheral) using a two-component developing method, a visible image obtained by developing a latent image formed on a photoconductor with toner is transferred to a medium (paper or resin sheet). In general, two-component developing agent includes toner and carrier and a developing agent layer is formed on a developing sleeve in which a stationary magnet is arranged. The toner adheres to an electrostatic latent image to develop it through the rotation of the developing sleeve.

Since it is required to regulate the thickness of the developing agent conveyed through the rotation of the developing sleeve, a doctor blade facing the developing sleeve is arranged.

However, as the doctor blade gets warm during image formation, the developing agent fixes to the back side (rear end along a forward rotation direction of the sleeve) of the doctor blade. In order to remove the stuck developing agent, a control (reverse rotation control) is carried out to enable a stirring mixer and the developing sleeve that rotate forward generally to rotate reversely temporarily. Such a reverse rotation is generally performed after a series of image forming jobs is completed.

However, in the image forming apparatus with such a constitution, if the developing sleeve is rotated reversely, the developing agent may be aggregated and fixed to the front side (front end along the forward rotation direction of the sleeve) of the doctor blade next time.

The present invention provides an image forming apparatus that can remove the agglomerate of the developing agent formed on the back side and the front side of the doctor blade to obtain a high-quality image.

DETAILED DESCRIPTION

In accordance with one embodiment, an image forming apparatus comprises a developing roller including a magnet in which a plurality of magnetic poles are arranged and a rotatable sleeve which conveys a developing agent including toner and carrier to develop a latent image formed on a photoconductor, a motor configured to rotate the sleeve and a rotational direction of a motor control section configured to rotate the motor forward or reversely when an image forming job is completed, to rotate the sleeve in a direction reverse to a rotational direction of the sleeve in the image forming job for a reverse rotation time and then rotate the sleeve in a direction same as the rotational direction of the sleeve in the image forming job for a forward rotation time shorter than the reverse rotation time.

(Whole Constitution of an Image Forming Apparatus)

Figure 1:
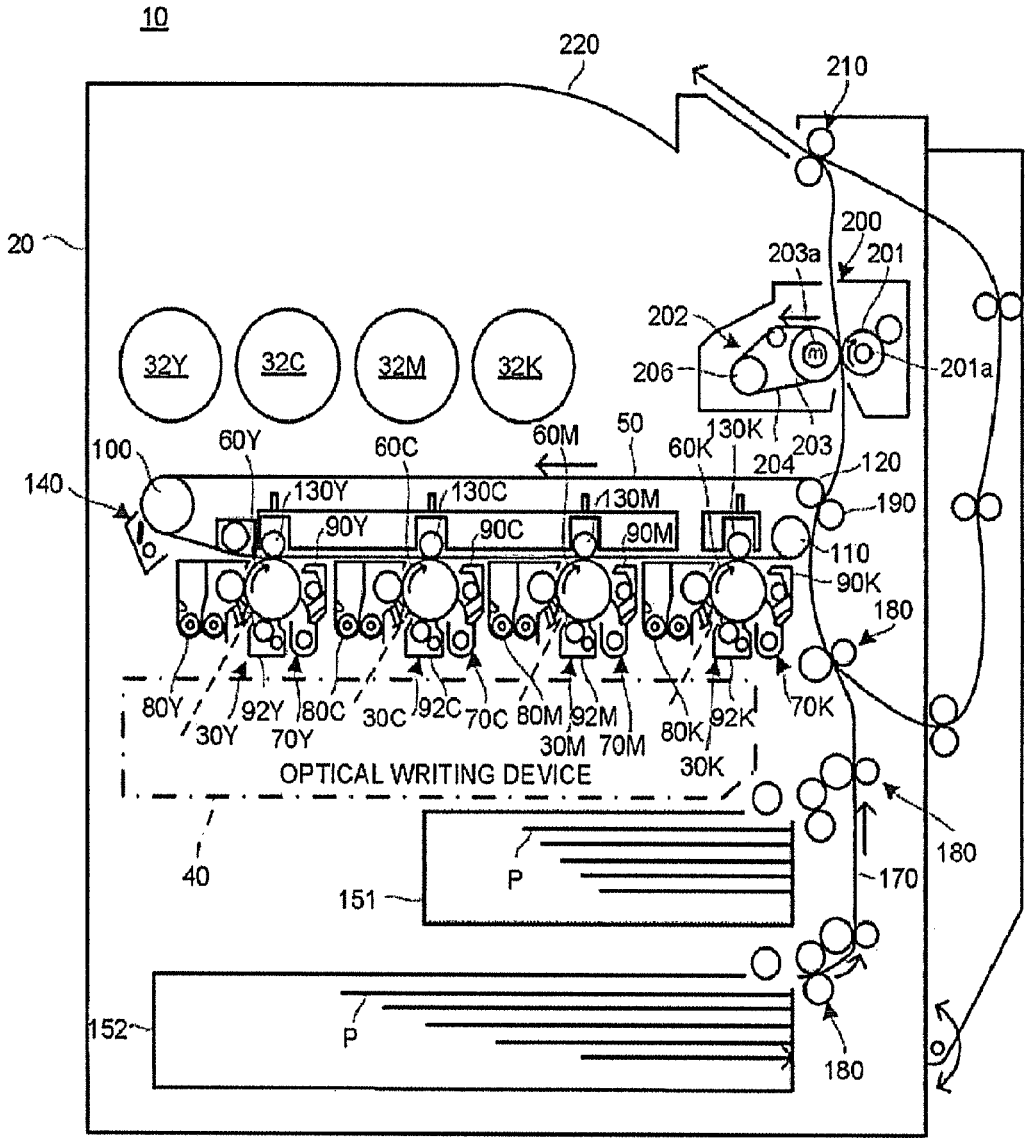
FIG. 1 is a diagram illustrating the whole constitution of a color image forming apparatus according to one embodiment.

FIG. 1 is a diagram illustrating the schematic constitution of a color image forming apparatus 10 to which a developing device is applied according to the embodiment. As shown in FIG. 1, process units 30 of yellow (Y), cyan (C), magenta (M) and black (K) are arranged in parallel inside a main body case 20 of the image forming apparatus 10. The process unit 30 of each color has the same constitution, and Y, M, C and K indicating the colors of the process units 30 are applied respectively following a reference numeral of each process unit 30 when it is required to distinguish each color of these process units 30.

The process units 30Y, 30M, 30C and 30K are respectively provided with photoconductors 60Y, 60M, 60C and 60K arranged in parallel with respect to an intermediate transfer belt 50 to which a light beam from optical writing devices 40Y, 40M, 40C and 40K (represented by 40 collectively in FIG. 1) are irradiated.

In the process units 30Y, 30C, 30M and 30K, the toner of different colors (yellow, cyan, magenta and black) supplied from toner bottles 32Y, 32C, 32M and 32K arranged at an upper portion is used to form toner images of different colors. The toner bottles 32Y, 32C, 32M and 32K are installed in a detachable manner such that they can be exchanged with new toner bottles if the toner in each of the toner bottles 32Y, 32C, 32M and 32K is run out. The process units 30Y, 30C, 30M and 30K are common, and therefore they will be described by omitting the appended symbol indicating the color.

Figure 2:
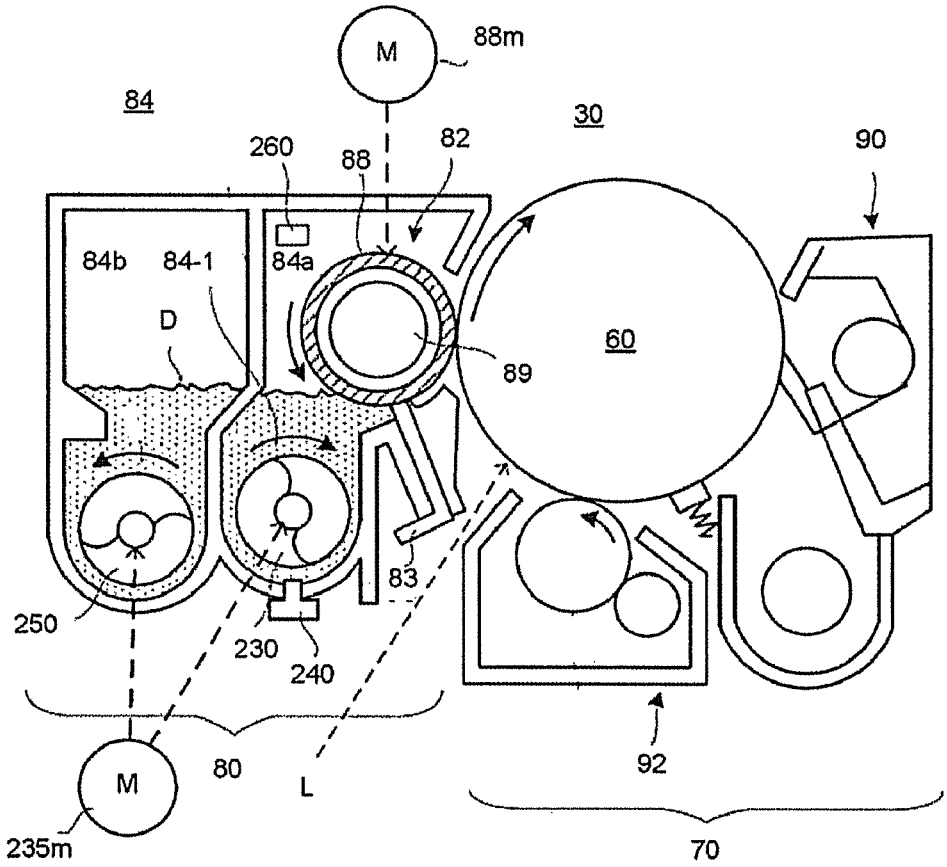
FIG. 2 is a diagram illustrating a common process unit of each color according to the embodiment.

As shown in FIG. 2, the process unit 30 is constituted by a developing device 80 and a photoconductor unit 70 including the photoconductor 60 that is driven to rotate towards an arrow direction. The photoconductor unit 70 comprises a cleaning device 90 and a charging device 92 around the photoconductor 60.

A photoconductive layer is arranged on the cylindrical outer periphery of the photoconductor 60, and the photoconductor 60 is driven to rotate through a driving motor (not shown) at the time of image formation. The light beam emitted from the optical writing device 40 is irradiated on the outer periphery of the photoconductor 60, and in this way, an electrostatic latent image according to the image is written on the outer periphery of the photoconductor 60.

The developing device 80 supplies toner to the photoconductor 60. The supplied toner is adhered to the electrostatic latent image written on the outer periphery of the photoconductor 60, and thus the electrostatic latent image on the photoconductor 60 is visualized as a toner image.

Though it is not shown in FIG. 2, the optical writing device 40 carries out a scanning process based on image information (for example) by irradiating each photoconductor 60 with a laser beam through a plurality of lens mirrors while polarizing the laser beam by a polygon mirror, or carries out the scanning process using an LED array.

Return to FIG. 1, the intermediate transfer belt 50 is a loop-shaped belt formed by taking resin film or rubber (for example) as a substrate to which the toner image formed on the photoconductor 60 is transferred. The intermediate transfer belt 50 is supported by rollers 100, 110 and 120 and driven to rotate towards an arrow direction. Four primary transfer rollers 130Y, 130C, 130M and 130K for transferring the toner image on each photoconductor 60 to the intermediate transfer belt 50 are arranged at the inner periphery side of the intermediate transfer belt 50, that is, the inner side of the loop.

The intermediate transfer belt 50 is nipped between the primary transfer rollers 130Y, 130C, 130M and 130K and the photoconductors 60Y, 60C, 60M and 60K, and as a result, a primary transfer nip is formed. The primary transfer rollers 130Y, 130C, 130M and 130K are arranged to be abutted against the inner side of the intermediate transfer belt 50. A primary transfer bias is applied to these primary transfer rollers 130Y, 130C, 130M, and 130K, and the toner images of the photoconductors 60Y, 60C, 60M and 60K are transferred to the surface of the intermediate transfer belt 50 through a potential difference between the primary transfer rollers 130Y, 130C, 130M, and 130K and the photoconductors 60Y, 60C, 60M and 60K.

In this way, the toner image formed on each of the photoconductors 60Y, 60C, 60M and 60K is sequentially overlapped and transferred to the intermediate transfer belt 50, and thus a color toner image is formed on the intermediate transfer belt 50. Further, a cleaning section 140 for cleaning remained toner, paper dust and the like adhered to the outer periphery of the intermediate transfer belt 50 is arranged at the outer periphery side of the intermediate transfer belt 50, that is, at the outer side of the loop.

A first paper feed tray 151 and a second paper feed tray 152 are arranged for stacking and holding, for example, media (papers for image formation) P of different sizes below the four process units 30Y, 30C, 30M and 30K and the optical writing device 40 inside the main body case 20. The media P stacked and held in the first paper feed tray 151 and the second paper feed tray 152 are sequentially fed from the one at the uppermost through a paper feed roller.

A conveyance path 170 on which the medium P separated and fed from the first paper feed tray 151 and the second paper feed tray 152 is conveyed is formed in the main body case 20. Thus, the media P stored in each of the paper feed trays 151 and 152 are taken out from the one at the uppermost and conveyed one by one on the conveyance path 170 by driving a plurality of paper feed rollers to rotate.

A register roller 180, a transfer roller 190, a fixing device 200, a paper discharge roller 210 and the like are arranged on the conveyance path 170. The medium P is conveyed from the first paper feed tray 151 or the second paper feed tray 152. A secondary transfer nip is formed between the roller 120 where the intermediate transfer belt 50 passes through and the transfer roller 190. Each color toner image transferred to the intermediate transfer belt 50 is transferred to the medium P during the process of passing through the secondary transfer nip.

The register roller 180 is a roller that is driven to rotate intermittently at giving timings. By driving the register roller 180 to rotate intermittently, the stopped medium P is fed to a transfer position nipped by the intermediate transfer belt 50 and the transfer roller 190. Then, during the process in which the medium P passes through the transfer position, the toner image on the intermediate transfer belt 50 are transferred to the medium P. The register roller 180, the intermediate transfer belt 50 and the transfer roller 190 constitute a primary transfer device.

The fixing device 200 applies heat and pressure to the medium P to which the toner image is transferred to fuse the toner, and fixes the toner image on the medium P. The fixing device 200 is constituted by a press roller 201 in which, for example, a fixing heater 201*a* serving as a heat source is arranged and a fixing belt unit 202.

Further, the fixing belt unit 202 is constituted by a fixing belt 204, a heating roller 203 in which, for example, a fixing heater 203*a* serving as a heat source is arranged, a driving roller 206 and the like. The fixing belt 204 rotates in an anticlockwise direction through the driving roller 206, and is heated by the heating roller 203 to be maintained at a constant temperature. The press roller 201 also rotates clockwise, and is heated by the heat source inside the press roller 201 to be maintained at a constant temperature. The fixing belt 204 is abutted against the press roller 201 to form a fixing nip.

During the process in which the medium P passes through the intermediate transfer belt 50, the full color toner image on the intermediate transfer belt 50 is transferred to the medium P, and then the medium P is conveyed to the fixing device 200. The medium P passes through the fixing device 200 such that the toner image is to be subjected to a fixing processing. Then, the medium P is discharged to a paper discharge tray 220 formed on the upper surface portion of the main body case 20 through the paper discharge roller 210.

As stated above, the process unit 30 includes the photoconductor unit 70 and the developing device 80. The photoconductor unit 70 is provided with the cleaning device 90 on the side of the photoconductor 60, and the charging device 92 below the photoconductor 60.

The surface potential lowers only in an area exposed by a laser light L of the photoconductor 60, and an electrostatic latent image is formed on the area of the photoconductor 60. The electrostatic latent image is conveyed to a developing area facing a developing roller 82 of the developing device 80 through the rotation of the photoconductor 60.

(Schematic Constitution of the Image Forming Apparatus)

Figure 3:
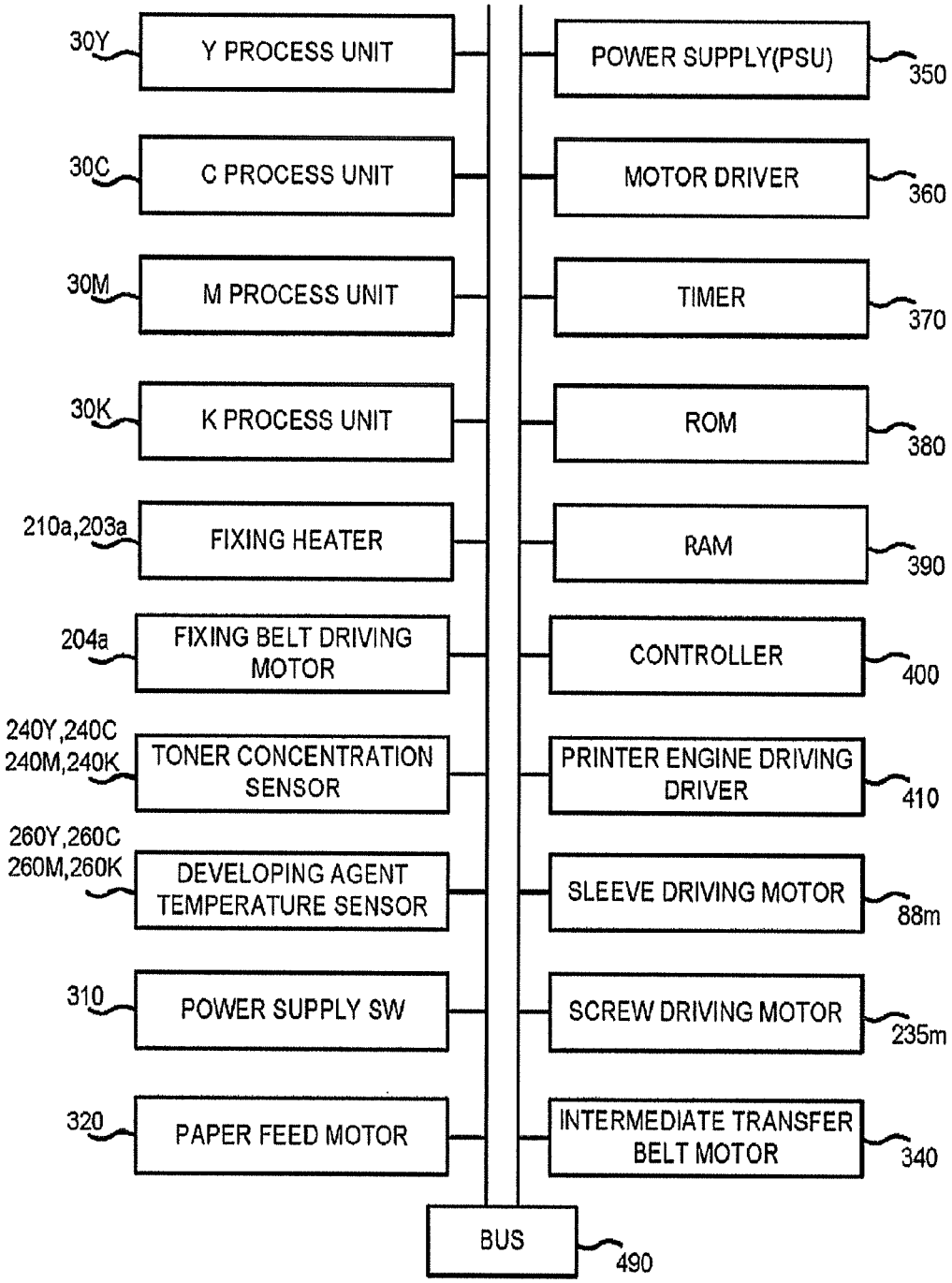
FIG. 3 is a diagram illustrating an example of the constitution of an electronic control circuit in the image forming apparatus according to the embodiment.

FIG. 3 is a block diagram illustrating the schematic constitution of the image forming apparatus 10. As shown in FIG. 3, the process units 30Y, 30C, 30M and 30K of each color, the fixing heaters 201*a* and 203*a*, a fixing belt driving motor 204*a*, a toner concentration sensor 240 (240Y, 240C, 240M and 240K) and a developing agent temperature sensor 260 (260Y, 260C, 260M and 260K) are arranged in the image forming apparatus 10. Further, a power supply switch 310, a paper feed motor 320, an intermediate transfer belt motor 340, a power supply 350, a motor driver 360, a timer 370, and an ROM (Read Only Memory) 380, an RAM (Random Access Memory) 390 are arranged in the image forming apparatus 10.

Further, a controller (control section 400), a printer engine driving driver 410, a sleeve driving motor 88*m*, and a screw driving motor 235*m* are arranged in the image forming apparatus 10, which are connected with each other via a bus 490. The controller 400 reads various control programs stored in the ROM 380 to drive the motor driver 360 and the printer engine driving driver 410 to rotate, and controls the process units 30Y, 30C, 30M and 30K, the fixing device 200, each motor of the paper feed motors 320 to convey the medium P along the conveyance path 170 and processes the image data to form (develop, transfer and fix) an image on the medium P.

Each of the paper feed motors 320 controls a rotation direction, a rotation torque, a rotation time to respectively drive the register roller 180, the transfer roller 190 and the paper discharge roller 210 to rotate in response to a conveyance timing of the medium P, and drives paper feed rollers for taking the media P stored in the first paper feed tray 151 and the second paper feed tray 152 to rotate.

The control programs which are stored in the ROM 380 includes a control program for controlling the process units 30Y, 30C, 30M and 30K and the fixing device 200 such that the image is formed on the medium P based on an image forming job and a control program for individually controlling each paper feed motor 320 and the intermediate transfer belt motor 340 and the like together with the image forming control.

The ROM 380 further stores a control program which controls the rotation direction, rotation speed and the like of the screw driving motor 235*m* controlling to rotate screw members 230 and 250 stirring the developing agent. The RAM 390 stores data obtained by temporarily storing and calculating various data received via the bus 490 and controlled by the controller 400.

The driving of the sleeve driving motor 88*m* and the driving of the screw driving motor 235*m* are carried out based on a driving command from the controller 400.

(Replenishing and Conveyance of the Developing Agent)

The toner concentration sensor 240 is arranged in a developing chamber 84 for detecting the toner concentration of a developing agent D in a developing container. The toner concentration sensor 240 outputs a signal (concentration sensor detection voltage) measured corresponding to the residual quantity of toner in the developing container. Further, the developing agent temperature sensor 260 is also arranged in the developing chamber 84 for detecting the temperature of the developing agent D in the developing container.

A developing agent replenishing device (not shown) replenishes the developing agent in the developing container based on the output from the toner concentration sensor 240.

A doctor blade 83 is arranged at the lower side of the developing roller 82 to regulate the thickness of toner adhered to the surface of the developing roller 82 (a developing sleeve 88) to a defined dimension. Then, the toner passing through the doctor blade 83 is conveyed to the surface of the photoconductor 60.

The developing device 80 comprises the developing chamber 84 including two developing chambers 84*a* and 84*b*, and the developing roller 82 that is arranged such that part of the developing roller 82 exposes from a first conveyance path 84-1 of the first developing chamber 84*a*. On the first conveyance path 84-1, the screw member 230 for stirring and conveying the developing agent and the toner concentration sensor 240 for detecting the toner concentration based on the measurement of the magnetic permeability of the developing agent are arranged.

The developing device 80 forms a layer of the developing agent D on the developing sleeve 88 to supply the toner to a position where the photoconductor 60 faces the developing sleeve 88, that is, a developing position.

The primary transfer device is arranged at the transfer position of each photoconductor 60 to overlap and form a toner image on the intermediate transfer belt 50. The medium P supplied from the paper tray is conveyed to the transfer position, and then the color toner image from the intermediate transfer belt 50 is secondarily transferred to the medium P. The medium P to which the toner image is transferred is conveyed to the fixing device 200, and the toner image is fixed through heat and pressure. Then, the medium P on which the toner image is fixed is discharged.

On the other hand, the toner left on the photoconductor 60 is removed by the cleaning device 90 after the transfer of the toner image to the medium P is ended. The photoconductor 60 restores to an initial state and becomes a standby state for a next image formation. By repeating the process operations described above, the image formation is carried out continuously.

The screw member 230 and the developing sleeve 88 are arranged on the first conveyance path 84-1 of the developing device 80. The screw member 230 stirs the replenished developing agent and supplies toner to the photoconductor 60 through the rotating developing sleeve 88. A high voltage for developing is applied to the developing sleeve 88, and the toner is developed in the electrostatic latent image on the photoconductor 60 through a reversal development.

As shown in FIG. 2, the developing sleeve 88 is driven by the sleeve driving motor 88*m*. The screw members 230 and 250 are driven by the screw driving motor 235*m*. On the other hand, the photoconductor 60 is driven by another motor (not shown).

(Developing Mechanism)

Figure 4:
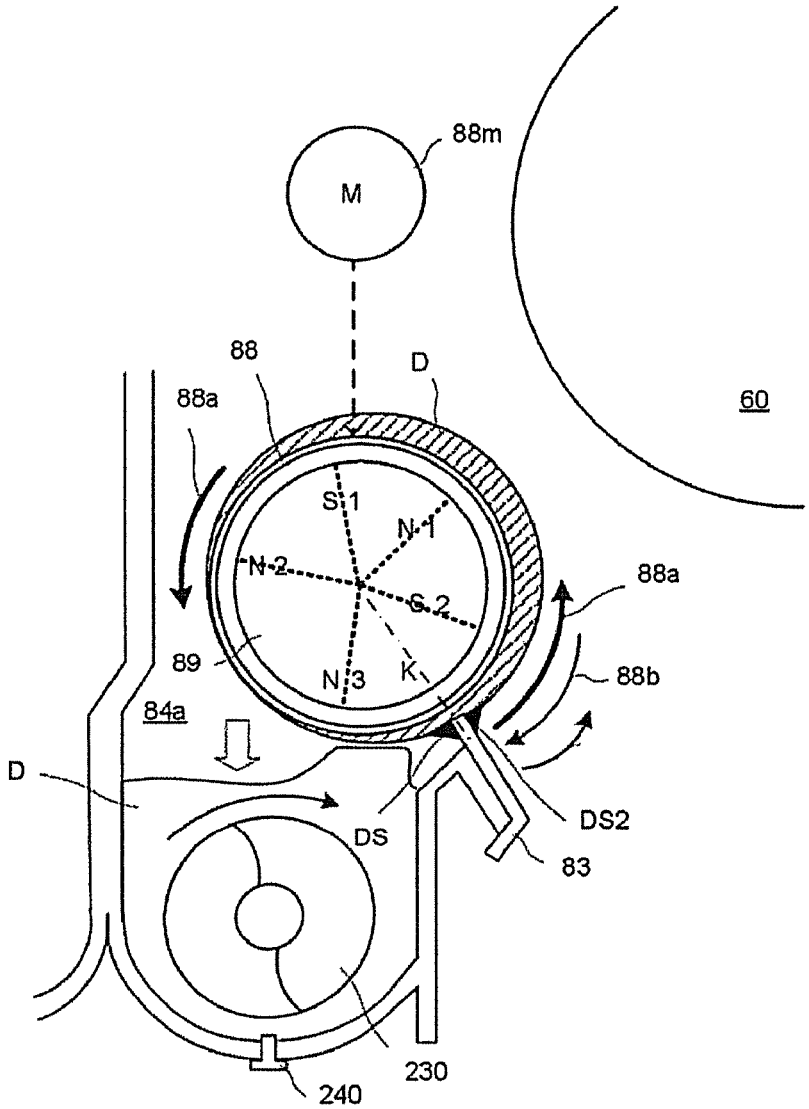
FIG. 4 is a diagram illustrating a situation in which a developing agent is conveyed through a reverse rotation of a screw member in a developing chamber according to the embodiment.

FIG. 4 is a brief constitution diagram of a developing section for supplying the developing agent on the first conveyance path 84-1 to the photoconductor 60 via the developing roller 82. The developing roller 82 is a developing agent D carrier for carrying the developing agent, and is arranged at the opening port of the developing chamber 84 in the developing device 80 facing the photoconductor 60. The developing roller 82 includes the non-magnetic developing sleeve 88 and a magnet roller 89 that is arranged inside the developing sleeve 88. The magnet roller 89, which is fixed, attracts the magnetic carrier contained in the developing agent D magnetically to the developing sleeve 88. The developing sleeve 88 is driven by the sleeve driving motor 88*m* to rotate forward or rotate reversely. The magnetic carrier to which the toner is adhered is conveyed around the developing sleeve 88 through the rotation.

If described further in detail, as shown in FIG. 4, the fixed magnet roller 89 has a constitution in which N-poles and S-poles are arranged alternately around the magnet roller 89 excluding a part thereof. That is, there is an S2-pole, a N1-pole, an S1-pole, a N2-pole and a N3-pole in the rotation direction of the developing sleeve 88. Each of the adjacent N3-pole and S2-pole, the adjacent S2-pole and N1-pole, the adjacent N1-pole and S1-pole, and the adjacent S1-pole and N2-pole is different from each other in polarity, and thus the magnetic carrier is attracted to the developing sleeve 88 in these areas (areas between the two adjacent magnetic poles). On the other hand, the N2-pole and the N3-pole has the same polarity, and thus the magnetic carrier falls to the developing chamber 84*a* without being attracted.

The developing sleeve 88 rotates in the anticlockwise direction as indicated by a thick arrow 88*a* in FIG. 4 at the time of carrying out an image formation. From the N3-pole to the S2-pole of the magnet roller 89, the developing agent D in the developing chamber 84*a* is attracted to the developing sleeve 88. The developing agent D attracted through magnetism is moved in a direction of the arrow 88*a* close to the photoconductor 60. Then, the toner in close proximity to the photoconductor 60 is attracted to the electrostatic latent image on the surface of the photoconductor 60, and in this way, a developing processing is carried out.

If the developing sleeve 88 further rotates in the direction of the arrow 88*a*, the developing agent D including the toner passes the N2-pole of the magnet roller 89, and the attractive force of the magnet roller 89 to the magnetic carrier is weakened. Thus, the developing agent D falls to the developing chamber 84*a*. Herein, an area where the adjacent magnetic poles have the same polarity such as a space between the magnetic pole N2 and the magnetic pole N3 is referred to as a developing agent separating area, and an area where the adjacent magnetic poles have different polarities such as a space between the magnetic pole N3 and the magnetic pole S2 is referred to as a developing agent adhering area.

Further, the screw driving motor 235*m* are in synchronization with the sleeve driving motor 88*m*, and thus the two motors are rotated reversely at the same time. Then, through the reverse rotation of the screw driving motor 235*m*, the screw members 230 and 250 are rotated reversely and the movement direction of the developing agent in the developing chambers 84*a* and 84*b* is the reverse direction.

(Scrapping and Soft-Caking Phenomenon of the Developing Agent)

At the time of a developing processing, in order to set the thickness of the developing agent D that is adhered to the developing sleeve 88 and moves at the time of the forward rotation to a specific thickness, the developing agent D is scraped off by the doctor blade 83. The developing agent D passing through a space between the doctor blade 83 and the developing sleeve 88 is conveyed to the surface of the photoconductor 60.

Incidentally, the doctor blade 83 is generally warmed by a heater for dew condensation prevention when printing or at a standby time. This is also one reason why the developing agent D is aggregated and fixed to the back side of the doctor blade 83 when the developing agent D is scrapped off by the doctor blade 83, and an agglomerate DS of the developing agent D due to a so-called soft-caking phenomenon is easy to occur. If a developing process is carried out directly, a white streak appears in the image formed through the developing process, which leads to an image quality deterioration.

Thus, in order to prevent the developing agent D from fixing, the sleeve driving motor 88*m* is rotated reversely to rotate the developing sleeve 88 in the reverse direction. Thus, the developing agent D hasn't been in contact with the doctor blade 83 for a long time, and thus it is possible to prevent the aggregation and fixing of the developing agent D due to the soft-caking.

Through a reverse rotation indicated by an arrow 88*b* in FIG. 4, the movement direction of the developing agent D on the developing sleeve 88 is to be reversed with respect to the doctor blade 83. Thus, the agglomerate DS of the developing agent D at the back side of the doctor blade 83 will not be destroyed.

Incidentally, in recent years, the image forming apparatus has used low-melting point toner for the main purpose of saving energy. For this reason, it is desired to prevent the toner from adhering to the components of the developing section through stress and heating between the developing section and the developing agent layer regulating section based on the doctor blade 83. Thus, it is preferable that the doctor blade 83 is arranged to be in close proximity to the developing roller 82 between magnetic poles of the magnet roller 89. In general, the doctor blade 83 is arranged at a position where the magnetic force in a normal direction K between magnetic poles having different polarities becomes least.

Thus, for example, it is arranged in such a manner that the magnetic pole S2 of the magnet roller 89 is positioned between the doctor blade 83 and a close position to the photoconductor 60 of the developing sleeve 88 as shown in FIG. 4. However, if in such a position relation, the warmed developing agent D is strongly attracted to the magnetic pole S2 when the developing sleeve 88 rotates reversely. Thus, an agglomerate DS2 of the developing agent D due to the soft-caking phenomenon may be formed at the front side of the doctor blade 83.

Thus, after the developing sleeve 88 is rotated reversely for only a given reverse rotation time Tn, the developing sleeve 88 is rotated forward for only a given forward rotation time Tp. In this way, the agglomerate DS2 of the developing agent D formed at the front side of the doctor blade 83 can be destroyed. The detailed description will be given later.

(An Example of the Constitution of a Forward/Reverse Rotation Control of One Embodiment of Present Invention)

Figure 5:
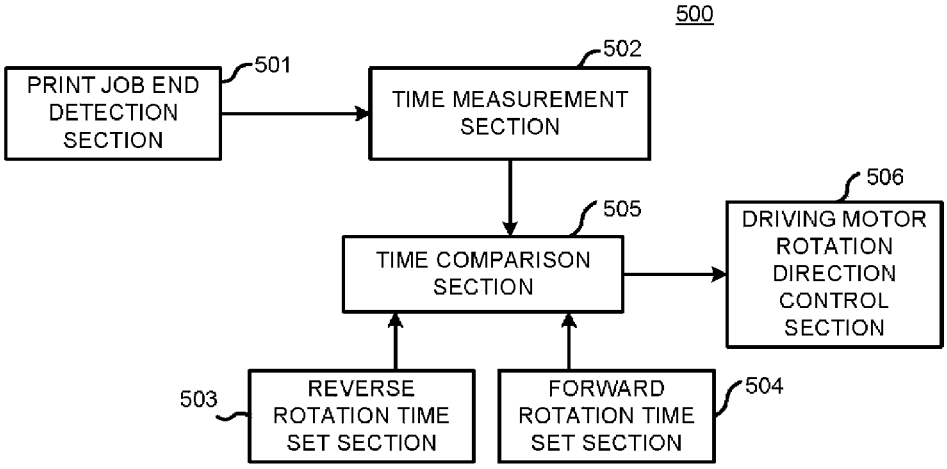
FIG. 5 is a block diagram illustrating an example of the constitution of a motor forward/reverse rotation control section carrying out a control of a reverse control and a forward rotation after an image forming job is ended according to the embodiment.

FIG. 5 is a diagram illustrating an example of the functional constitution of a motor forward/reverse rotation control section according to the embodiment. A motor forward/reverse rotation control section 500 comprises an image forming job end detection section 501 which detects the end of an printing job, a time measurement section 502 which starts a time measurement upon detecting the end of the image forming job, a reverse rotation time set section 503 which sets a reverse rotation time of the developing sleeve 88, a forward rotation time set section 504 which sets a forward rotation time after the reverse rotation time, a time comparison section 505 which compares the time measured by the time measurement section 502 with the set reverse rotation time or the set forward rotation time, and a driving motor rotation direction control section 506 which controls rotation directions of the sleeve driving motor 88*m* and the screw driving motor 235*m*.

FIG. 5 is a functional diagram illustrated for facilitating the knowing of the functions of the present embodiment, and in most cases, the functions are carried out by each block shown in FIG. 3 in practice. For example, the function of time measurement by the time measurement section 502 is carried out by the timer 370 actually. The time set by the reverse rotation time set section 503 and the time set by the forward rotation time set section 504 are stored in a specific storage area in the RAM 390.

The time comparison by the time comparison section 505 is carried out through the controller 400 by comparing the measured time of the timer 370 with the set time stored in the RAM 390. The set time set by the reverse rotation time set section 503 and the set time set by the forward rotation time set section 504 are input by the operator from the outside. The set time may be preset as an initial value. When the set forward rotation time is longer than the reverse rotation time, a voice of the message is given such as carrying out a display drawing the operator's attention to the message.

The controller 400 detects that the time measured by the time measurement section 502 reaches the time set by the reverse rotation time set section 503 or the time set by the forward rotation time set section 504. Then, the controller 400 sends a control signal representing that it reaches the set time to the driving motor rotation direction control section 506. Upon receiving the control signal, the driving motor rotation direction control section 506 rotates the sleeve driving motor 88*m* reversely or forward in response to the content of the control signal.

(Description of Operations of Flowchart)

Figure 6:
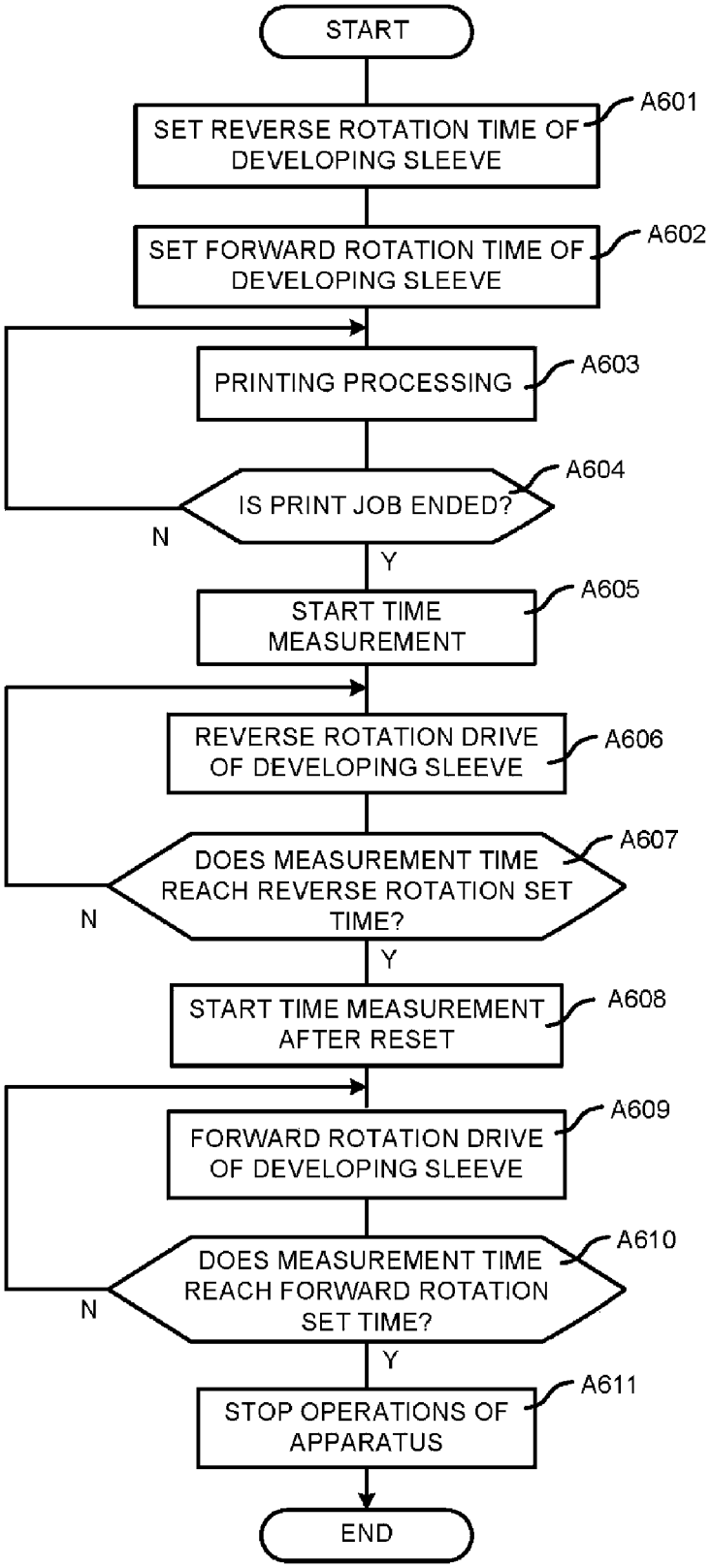
FIG. 6 is a diagram illustrating a flowchart for illustrating operations of the embodiment.
Figure 7:
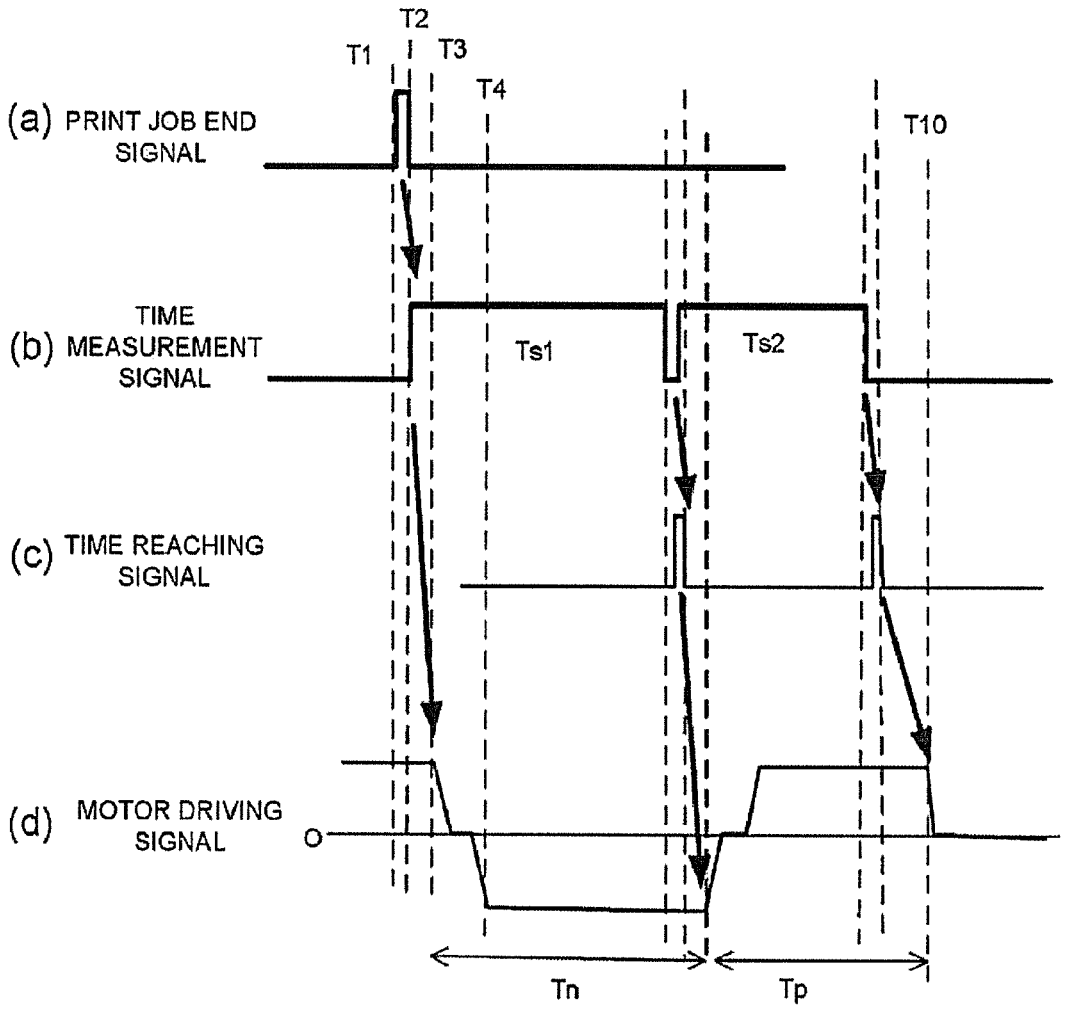
FIG. 7 is a diagram illustrating a timing chart for illustrating the operations of the embodiment.

Next, the operations of the embodiment stated above are described based on a flowchart shown in FIG. 6 and a timing chart shown in FIG. 7.

In FIG. 7, (a) is a print job end signal, (b) is a time measurement signal, and (c) is a time reaching signal representing that it reaches the specific reverse rotation time and the forward rotation time. Further, FIG. 7(*d*) is a motor driving signal of the developing sleeve 88. In FIG. 7(*d*), the time when the voltage is a negative voltage indicates that the developing sleeve 88 is driven to rotate reversely, and the time when the voltage is positive voltage indicates that the developing sleeve 88 is driven to rotate forward. It is set that the forward rotation time Tp is shorter than the reverse rotation time Tn.

Further, in FIG. 7, the reverse rotation time Tn and the forward rotation time Tp respectively indicate the time starting from a state in which the signal is received, and the time of the practical reverse rotation state and the time of the practical forward rotation state are often respectively shorter than Tn and Tp. In this case, the time of the forward rotation state is also set to be shorter than the time of the reverse rotation time.

As a start of the operations of the image forming apparatus 10, first, the operator inputs and sets the reverse rotation time Tn of the developing sleeve 88 after the image forming job is ended in the reverse rotation time set section 503 in ACT A601. When the reverse rotation time isn't input in advance, an initial value thereof may also be defined.

In the following ACT A602, the forward rotation time Tp after the reverse rotation of the developing sleeve 88 is input and set. An initial value may also be defined in advance for the forward rotation time Tp.

In ACT A603, the jobs of an image forming processing, that is, each processing of forming a latent image, developing with toner, transferring to the medium P, fixing on the medium P and discharging paper is carried out in each section of the image forming apparatus 10 shown in FIG. 1. Then, in ACT A604, when detecting that the image forming job is ended at a timing T1 shown in FIG. 7, the time measurement section 502 (the timer 370) starts to measure a time from a timing T2 under the control of the controller 400. As long as the image forming job has not been ended (N in ACT A604), the image forming processing is continued in ACT A603.

After the time measurement is started ACT A605, a reverse rotation drive of the developing sleeve 88 is carried out from a timing T3 in ACT A606. It takes some time to be the reverse rotation state from the forward rotation state of the motor, and the reverse rotation is carried out from a timing T4 actually.

Specifically, the time comparison section 505 detects a message indicating that the time (time Ts1 in FIG. 7(*b*)) measured by the time measurement section 502 reaches the set time set by the reverse rotation time set section 503 in ACT A607, and sends a forward rotation driving control signal indicating the message to the driving motor rotation direction control section 506. At this time, after the measurement time of the time measurement section 502 is temporarily reset in ACT A608, a time measurement is started again. The driving motor rotation direction control section 506 that received the forward rotation driving control signal stops the sleeve driving motor 88*m* that has been rotated reversely temporarily, and rotates the sleeve driving motor 88*m* forward this time in ACT A609. The time comparison section 505 compares the time (time Ts2 in FIG. 7(*b*)) measured by the time measurement section 502 with the time set by the forward rotation time set section 504.

In ACT A610, it is detected whether or not the measured time of the time measurement section 502 reaches the time preset by the forward rotation time set section 504. Such a time reaching detection is also carried out through the controller 400 by comparing the set time stored in the specific area in the RAM 390 with the time measured by the time measurement section 502 through the time comparison section 505. The processing in ACT A609 is carried out again to continue the forward rotation drive of the developing sleeve 88 until the forward rotation time reaches the set time in ACT A610.

If it is detected that the forward rotation time reaches the set time in ACT A610, the processing is proceeded to ACT A611 to stop operations such as an image formation of the image forming apparatus 10 (timing T10).

As stated above, every time an image forming job is ended, the developing sleeve 88 in the process unit 30 of each color (yellow, cyan, magenta and black) is rotated reversely for only a set reverse rotation time, and then is rotated forward for only a set forward rotation time shorter than the set reverse rotation time.

(Effect, Modification and the Like of the Present Invention)

In accordance with the embodiment described above, there is provided the image forming apparatus which removes an agglomerate of the developing agent in both the back side and the front side of the doctor blade to be capable of obtaining a high quality image.

Incidentally, in the embodiment described above, when the image forming job is ended, the developing sleeve is rotated reversely, and then is rotated for only a time shorter than the reverse rotation time.

However, it is not preferable that the developing agent separating area formed as stated above is in close proximity to the photoconductor because there is a possibility that a layer of the developing agent having a small thickness hits the surface of the photoconductor.

Thus, it is preferable that the reverse rotation amount of the developing sleeve for preventing the soft-caking is a degree in which the developing agent separating area is not in close proximity to the photoconductor. Thus, it is preferable that the angle of reverse rotation after the image forming job is ended is a degree in which the developing agent separating area is not in close proximity to the surface of the photoconductor, and the forward rotation time after the reverse rotation is shorter than the reverse rotation time. This means a rotational angle of the sleeve in a direction reverse to a rotational direction of the sleeve in the image forming job is set so that the developing agent separating area is away from facing position of the photoconductor and the developing roller.

It is exemplified in the embodiment described above that a magnetic pole positioned between the doctor blade and the photoconductor is a S-pole. However, the present invention is also applicable to a case in which the magnetic pole arranged at such a position is a N-pole. Further, in the embodiment described above, a case in which an area forming the developing agent separating area is formed between N-poles is described. However, the present invention is not limited to this case; and the present invention is also applicable to a case in which the developing agent separating area is formed between S-poles. Further, it is exemplified in the embodiment described above that a member for regulating the developing agent on the developing sleeve is the doctor blade. However, the member for regulating the developing agent is not limited to the doctor blade in the present invention, and may use a normal regulating member.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a developing roller including a magnet in which a plurality of magnetic poles are arranged and a rotatable sleeve which conveys a developing agent including toner and carrier to develop a latent image formed on a photoconductor;

a motor configured to rotate the sleeve; and a rotational direction of a motor control section configured to rotate the motor forward or reversely when an image forming job is completed, to rotate the sleeve in a direction reverse to a rotational direction of the sleeve in the image forming job for a reverse rotation time and then rotate the sleeve in a direction the same as the rotational direction of the sleeve in the image forming job for a forward rotation time shorter than the reverse rotation time.

2. The image forming apparatus according to claim 1, wherein a magnetic pole of the plurality of magnetic poles in a magnet roller is arranged between a position where the photoconductor is faced with the developing roller and a position where a regulating member is faced with the developing roller.

3. The image forming apparatus according to claim 2, wherein the magnet roller includes a developing agent adhering area where adjacent magnetic poles have different polarities and a developing agent separating area where the adjacent magnetic poles have the same polarities; and a rotational angle of the sleeve in a direction reverse to a rotational direction of the sleeve in the image forming job is set so that the developing agent separating area is away from facing position of the photoconductor and the developing roller.

4. An image forming apparatus according to claim 1, further comprising:

a regulating member configured to be arranged faced with the sleeve at a given distance to regulate a thickness of the developing agent conveyed by the sleeve.

5. An image forming apparatus, comprising:

a plurality of developing devices configured to develop a latent image to form a developed image;

a transfer device configured to transfer the developed image to a medium; and a fixing device configured to fix the image transferred to the medium by the transfer device, wherein the plurality of developing devices include a developing roller including a magnet in which a plurality of magnetic poles are arranged and a rotatable sleeve which conveys a developing agent including toner and carrier to develop the latent image formed on a photoconductor;

a motor configured to rotate the sleeve; and a rotational direction of the motor control section configured to rotate the motor forward or reversely when an image forming job is completed, to rotate the sleeve in a direction reverse to a rotational direction of the sleeve in the image forming job for a reverse rotation time and then rotate the sleeve in a direction same as the rotational direction of the sleeve in the image forming job for a forward rotation time shorter than the reverse rotation time.

6. The image forming apparatus according to claim 5, wherein a magnetic pole of the plurality of magnetic poles in a magnet roller is arranged between a position where the photoconductor is faced with the developing roller and a position where a regulating member is faced with the developing roller.

7. The image forming apparatus according to claim 6, wherein the magnet roller includes a developing agent adhering area where adjacent magnetic poles have different polarities and a developing agent separating area where the adjacent magnetic poles have the same polarities; and a rotational angle of the sleeve in a direction reverse to, a rotational direction of the sleeve in the image forming job is set so that the developing agent separating area is away from facing a position of the photoconductor and the developing roller.

8. An image forming apparatus according to claim 5, further comprising:

a regulating member configured to be arranged faced with the sleeve at a given distance to regulate a thickness of the developing agent conveyed by the sleeve.

* * * * *